United States Patent [19]

O'Ferrell et al.

[11] Patent Number: 4,793,371

[45] Date of Patent: Dec. 27, 1988

[54] PORTABLE SHELTER

[75] Inventors: J. Richard O'Ferrell; Kevin Butts, both of Phoenix, Ariz.

[73] Assignee: Ultra Shades, Inc., Phoenix, Ariz.

[21] Appl. No.: 125,933

[22] Filed: Nov. 27, 1987

[51] Int. Cl.[4] ..... E04H 15/44; E04H 15/64

[52] U.S. Cl. ..... 135/106; 135/118; 135/119

[58] Field of Search ..... 135/106, 115, 118, 119

[56] References Cited

U.S. PATENT DOCUMENTS

| | | | |
|---|---|---|---|
| 1,413,529 | 4/1922 | Hansen | 135/106 |
| 1,792,670 | 2/1931 | Wickstrum . | |
| 1,856,658 | 5/1932 | Rummler . | |
| 2,001,196 | 5/1935 | Jost | 135/118 X |
| 2,137,625 | 11/1938 | Norvell | 135/118 X |
| 2,513,729 | 7/1950 | Lemen . | |
| 2,535,618 | 12/1950 | Williams . | |
| 2,835,262 | 5/1958 | Collins . | |
| 2,840,400 | 6/1958 | D'azzo . | |
| 2,845,078 | 7/1958 | Singleton . | |
| 2,943,634 | 7/1960 | Morgan . | |
| 3,162,920 | 12/1964 | Durham | 24/265 |
| 3,212,512 | 10/1965 | Morris | 135/106 X |
| 3,424,178 | 1/1969 | Yazaki | 135/106 |
| 3,441,037 | 4/1969 | Transeau . | |
| 3,699,986 | 10/1972 | Kirkham . | |
| 4,003,181 | 1/1977 | Robinson et al. | 135/106 |
| 4,129,139 | 12/1978 | Powers . | |
| 4,286,612 | 9/1981 | Neal et al. | 135/106 X |
| 4,404,980 | 9/1985 | Wade | 135/102 |
| 4,422,468 | 12/1983 | Wilson | 135/97 |
| 4,641,676 | 2/1987 | Lynch | 135/110 |
| 4,709,718 | 12/1987 | Nichols | 135/106 |

*Primary Examiner*—J. Karl Bell

*Attorney, Agent, or Firm*—LaValle D. Ptak

[57] ABSTRACT

A portable tent-like shelter comprises an open frame made of tubular elements which slip fit together to form a roof portion. The frame has four elongated legs extending downwardly from the corners to cause the frame to be free-standing. A fabric cover is placed over the roof portion of the frame and the cover has boxed ends and sides which extend downwardly from the roof portion of the open frame. Elongated, narrow, fabric leg panels are attached to the fabric cover at each of its corners and extend downwardly along the legs of the frame. The leg panels are releasably attached to the legs at the lower ends to place tension through the leg panels to the cover to hold it in place on the frame.

26 Claims, 2 Drawing Sheets

FIG. 1
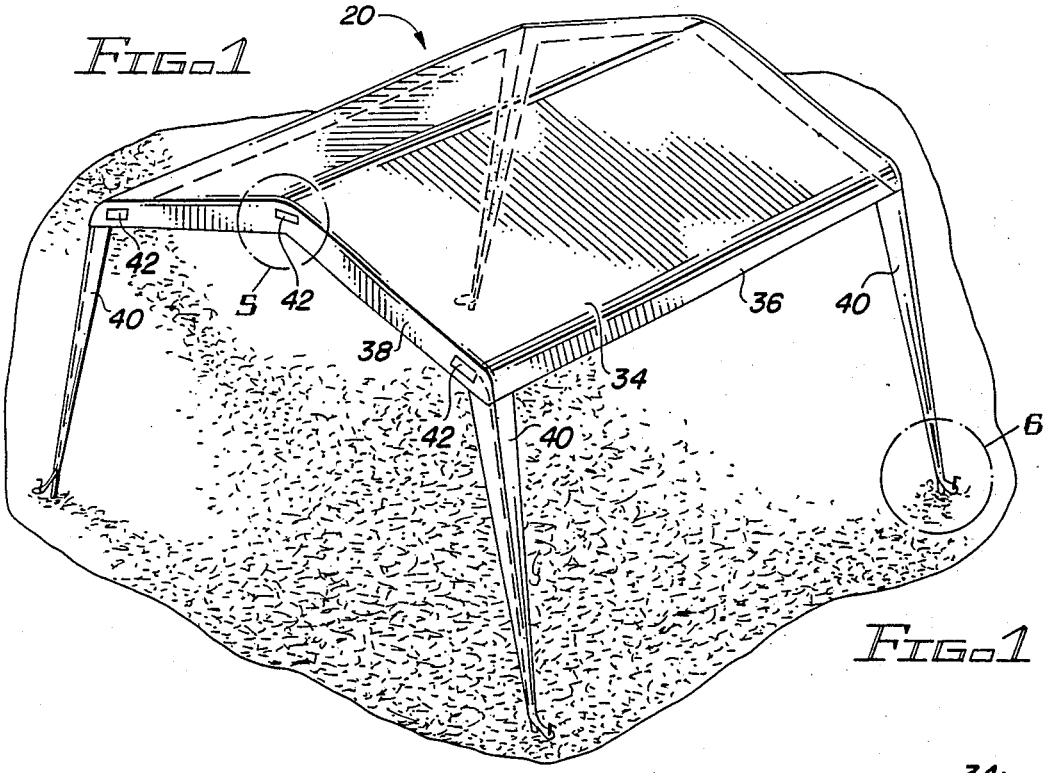
FIG. 1
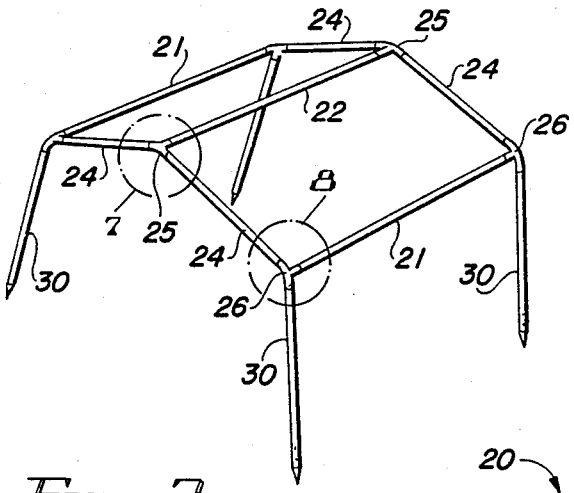
FIG. 2
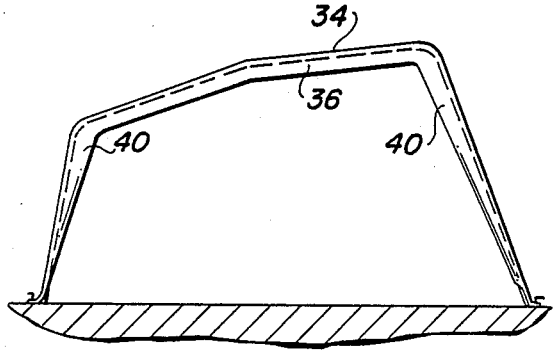
FIG. 4
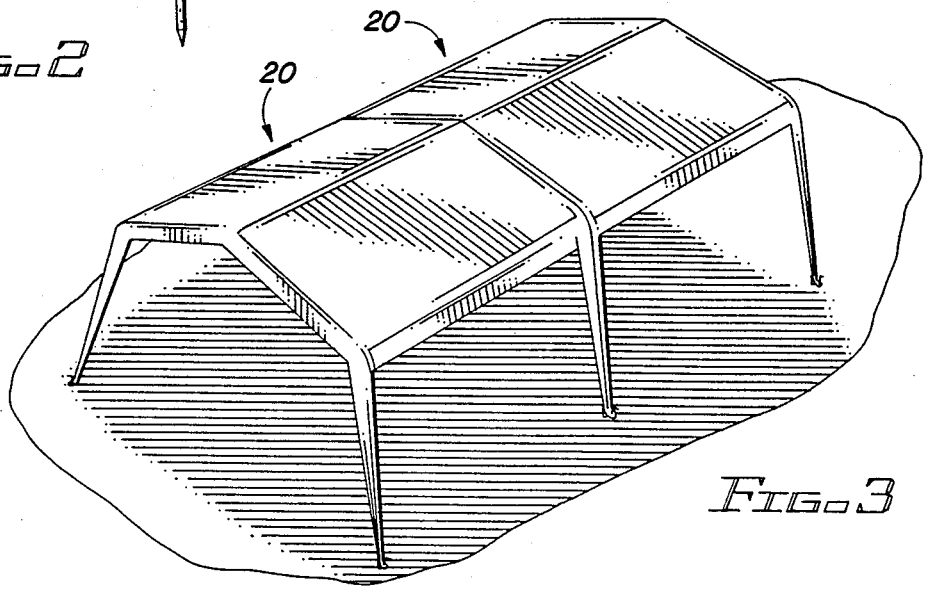
FIG. 3

PORTABLE SHELTER

BACKGROUND

A wide variety of applications exist for portable tent-like structures which may be used to cover a designated area to provide protection from the sun or rain or both. Typical applications are for covers over spas, outdoor patio tables and chairs, pools, picnic areas, horse stalls, automobiles, weddings, or other social events, and the like. Some of these uses are for relatively short periods of times, whereas for others, the cover may be left in place for weeks or months at a time without being moved. Most temporary covers and those used as a sun shield or rain shield for automobiles, horse stalls and boats, require an overhead canopy or "roof" with open sides, since the covers are not used as a shelter or living area, but primarily are used for protection from sun and rain.

In the past, various types of portable or temporary covers have been developed, but such covers either lack the desired simplicity of assembly and disassembly or do not provide for a wind proof holding down of the fabric placed over the frame of the structure. A number of patents directed to generally rectangular pole/roof structures over which a tent or roof of flexible material is placed, have been issued. Typical of these patents are the Patents to Wickstrum U.S. Pat. No. 1,792,690; Lemen U.S. Pat. No. 2,513,729; Williams U.S. Pat. No. 2,535,618; Collins U.S. Pat. No. 2,835,262; Kirkham U.S. Pat. No. 3,699,986; and Lynch U.S. Pat. No. 4,641,676.

In the Williams Patent, the tent material is secured to horizontal poles of an underlying free-standing frame by means of screws which extend through grommets in the fabric. This produces a secure means of fastening the fabric to the frame, but assembly and disassembly is quite time consuming. Some of the other patents simply illustrate the fabric as being placed over the top of the poles and these structures employ fabric with a "boxed" or downwardly depending edge to fit over the corners formed by the junctions of the vertical and horizontal members of the underlying pole frame. Without some interconnection, however, between the fabric and the frame, it is possible for a slight breeze to blow the fabric cover partially or completely off the frame.

The Patent to Kirkham discloses a number of different tent modules which may be interconnected together to form larger structures in a variety of different configurations. Kirkham, however, does not employ a free-standing pole structure or frame structure, but it is necessary for the fabric or tent material to be staked to the ground in order to provide structural rigidity or integrity to the shelter.

Other frame and fabric arrangements have long been used for tents of the type used by campers and backpackers. Some of these structures employ an internal frame which is erected inside a pre-shaped enclosed tent. Others employ a similar frame structure, but which is placed outside the tent material. The tent material then is suspended from the external frame. Typically, tent structures of this type are relatively small in size.

It is desirable to provide a portable shelter which overcomes the disadvantages of the prior art discussed above, which is simple to assemble and dismantle, and which provides a secure interconnection between the frame and the fabric with a minimum of effort.

SUMMARY OF THE INVENTION

Accordingly it is an object of this invention to provide an improved portable shelter.

It is another object of this invention to provide an improved portable shelter which is easy to assemble and dismantle.

It is an additional object of this invention to provide a portable tent-like shelter in which a fabric cover is placed over a frame and which quickly and easily stretches the fabric cover tightly over the frame and securely holds it in place when the structure is assembled.

It is a further object of this invention to provide an improved portable shelter structure in the form of structure modules which may be interconnected together to produce larger structures.

In accordance with the preferred embodiment of the invention, a portable shelter includes an open frame which has roof portions and elongated legs extending from the roof portions to the ground. The frame is freestanding and a fabric cover is placed over the roof portion of the frame. The fabric cover has elongated narrow fabric leg panels attached to each of its corners, and these leg panels extend from the roof portion along the elongated legs of the frame to terminate at a point near the ground. The fabric leg panels each are releasably attached to the corresponding elongated legs at a point near the ground to apply tension through the fabric leg panels to hold the fabric cover tightly in place on the roof portion of the frame.

BRIEF DESCRIPTION OF THE DRAWINGS

FIG. 1 is a perspective view of a preferred embodiment of the invention;

FIG. 2 is a perspective view of the frame portion of the embodiment shown in FIG. 1;

FIG. 3 is a perspective view of two of the embodiments of FIG. 1 interconnected together;

FIG. 4 is a side view of a variation of the embodiment of FIG. 1;

DETAILED DESCRIPTION

Reference now should be made to the drawings, in which the same reference numbers are used throughout the different figures to designate the same components. The preferred embodiment of the invention is illustrated in the perspective views of FIGS. 1 and 2. This embodiment comprises a portable tent-like shelter 20 which is erected over a light weight, corrosive resistant frame made of tubular aluminum or other suitable material.

Figure 7:
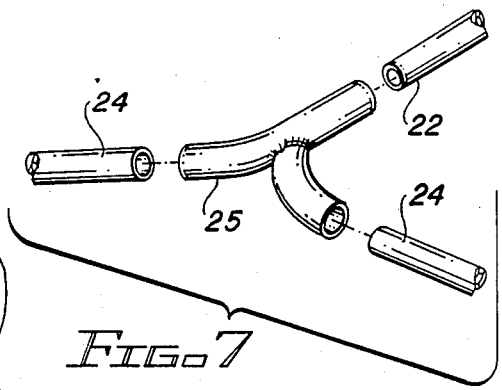
FIGS. 7 and 8 illustrate details of portions of the frame structure of FIG. 2.
Figure 8:
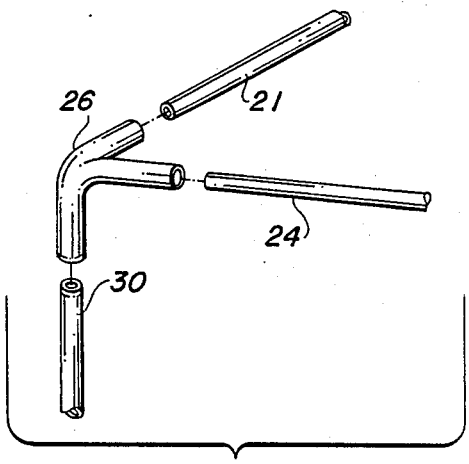

The frame is shown most clearly in FIG. 2 and is in the form of a generally rectangular top, with elongated legs 30 extending downwardly from each of the corners. The top portion of the frame includes a pair of elongated side members 21 and a roof ridge member 22. Four end members 24 then are used to interconnect the side members with the ridge member to form the roof portion of the frame. The interconnections are made through a pair of ridge pole connector elements 25 (shown most clearly in FIG. 7) and four corner connectors 26 (shown most clearly in FIG. 8).

Once the frame structure of FIG. 2 has been erected, a fabric cover is placed over the top of the frame structure as shown in FIG. 1. This cover has a large rectangular portion 34 which constitutes the roof of the shelter. The top 34 then has short downwardly extending side portions 36 and end portions 38 to form a boxed cover fitted over the top of the open frame of FIG. 2. This is shown most clearly in FIG. 1.

To secure the fabric cover to the underlying frame and to stretch the cover tightly against the frame to produce a neat appearance and to minimize the possibility of wind disturbing the cover, four elongated, narrow triangular fabric leg panels 40 are secured to the junctions of the boxed side and end panels 36 and 38 at each of the corners of the cover 34. These narrow, elongated panels are slightly wider at the top than at the bottom, as shown most clearly in FIG. 1, and extend to the ground where they are secured under tension to the elongated legs 30 to provide the finished structure shown in FIG. 1.

The fabric cover 34 and the various panels 36, 38 and 40 may be made of any suitable material. A typical material, which is used for producing a partial shade or sun screen, is in the form of a relatively open weave, sun resistant, stain resistant, fade proof fabric, of the type commonly used for beach umbrellas and patio umbrellas. If more complete shade is desired, opaque fabrics also may be employed; and if the purpose is to provide shelter from rain, obviously a water proof fabric, such as a tightly woven nylon or the like, may be used. The particular fabric which is chosen is dependent upon the ultimate use which is desired for the shelter's structure. Obviously, light-weight fabrics are preferred; and a variety of suitable light-weight fabrics currently are commercially available.

Figure 6:
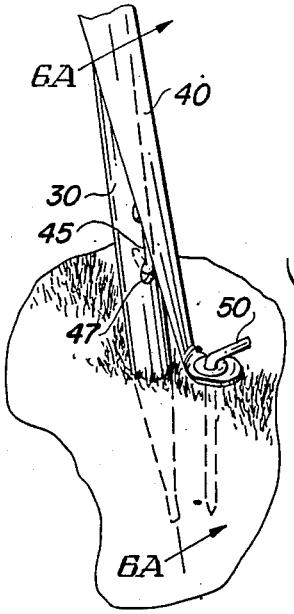
FIG. 6 illustrates a detail of the portion "6" circled in FIG. 1.
Figure 6A:
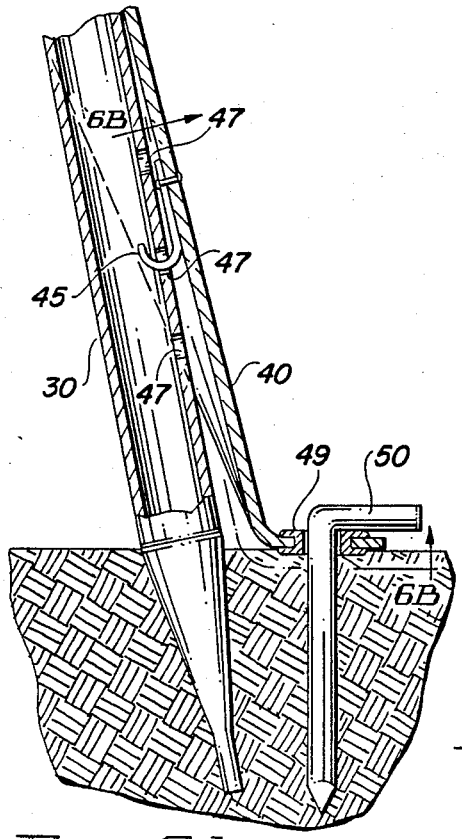
FIG. 6A is a cross-sectional view taken along the line 6A—6A of FIG. 6.
Figure 6B:
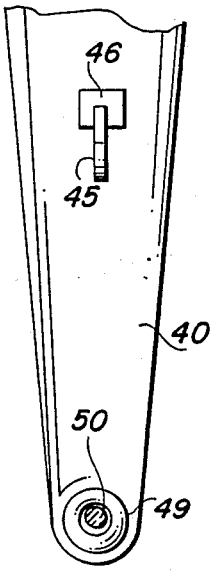
FIG. 6B illustrates a detail of the invention taken along the line 6B—6B of FIG. 6A.

Reference now should be made to FIGS. 6, 6A and 6B for details of the manner in which the narrow fabric leg panels 40 are attached to the lower ends of the elongated legs 30 of the frame to stretch the cover 34 tightly over the frame in a simple and effective manner. A short distance above the end of each of the panels 40, an inwardly turned hook 45 is secured by means of a stitched or riveted patch 46, as shown most clearly in FIGS. 6A and 6B. This hook 45 is placed on the inside surface of the panel 40, as is apparent from reference to FIGS. 6 and 6A.

Whenever possible, the pointed lower end of the leg 30 is driven into the ground, as shown in FIGS. 6 and 6A. Each panel leg 40 then is pulled tightly downward, and the hook 45 is placed into a suitable one of a plurality of holes 47 which are formed through the wall of the tubular leg 30, as shown most clearly in FIG. 6A. Many fabrics have some degree of "stretch" in them, and the hook 45 is placed into a suitable one of the holes 47 to stretch the corresponding panel 40 sufficiently to provide tension between the panel 40 and the cover 34 to which it is attached. This pulls the cover 34 tightly downwardly against the corner connectors 26 of the frame. A single hole 47 located at an appropriate point could be employed, but due to variations in manufacturing tolerances and to changes in the fabric over a period of time, it is desirable to provide a number of holes 47 parallel to the central axis of the elongated leg 30.

After the hooks 45 of all four of the panels 40 are placed in an appropriate hole 47, a stake 50 is driven through a grommet 49 located at the end of each of the panels 40 to additionally secure the panels to the ground. This is shown most clearly in FIGS. 6 and 6A. Obviously, if the shelter is erected on a hard surface, such as a concrete patio, the stake 50 is not employed and the tips of the elongated legs 30 simply rest on top of the concrete surface and are not driven into the ground. Suitable weights then may be located at each corner of the shelter and attached to the grommets 49, if desired.

Figure 9:
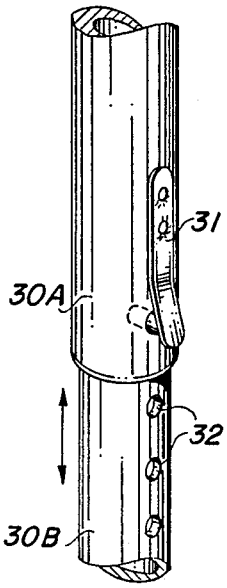
FIGS. 9 and 10 illustrate alternative embodiments for adjusting the lengths of the legs 30 of the embodiment shown in FIG. 2.
Figure 10:
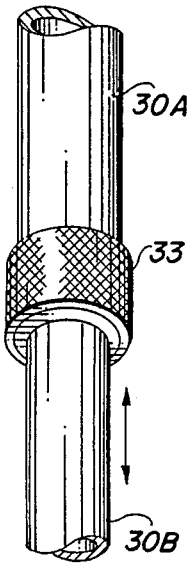

For some applications, such as on patios or on the beach where the cover is to be used as a sun shield, it may be desirable to shorten the elongated legs 30 of the frame at one end, while leaving the legs at the other end in their fully extended position. This also can be accomplished in a number of different ways. Obviously, a separate set of shorter legs 30 may be employed. In the alternative, each of the legs 30 may be constructed to permit a telescoping or extendable configuration in a conventional manner. Two different ways of accomplishing this are shown in FIGS. 9 and 10. In FIG. 9, the leg is formed of an upper portion 30A and a telescoping lower portion 30B. A spring loaded button 31 then is placed on the portion 30A to extend a projection through a hole adjacent the end of the spring which then may fit into any one of a desired number of corresponding holes 32 on the portion 30B to cause the leg to be of the desired length.

FIG. 10 shows another typical standard telescoping arrangement of an upper leg portion 30A and a smaller diameter telescoping lower leg portion 30B. A knurled fastener 33 then is used to secure the two legs together at the desired length.

Figure 11:
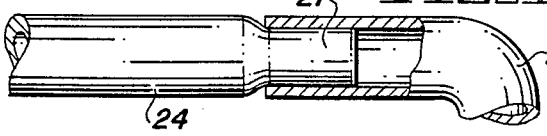
FIGS. 11 and 12 illustrate typical techniques which may be used to interconnect the frame of FIG. 2 together.
Figure 12:
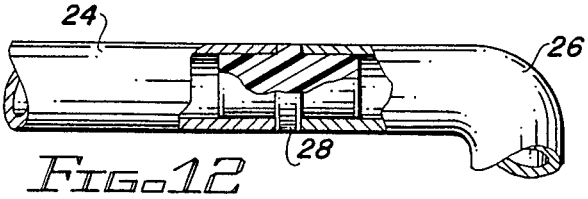

FIGS. 11 and 12 illustrate two different typical ways which may be used to interconnect the elongated pole portions or members of the frame, such as the various members 21, 22, 24, and 30, to the corner and ridge connectors 25 and 26. As illustrated in FIG. 11, each of the elongated members may be provided with reduced diameter ends which fit into the corresponding openings in the connector 26 or 25. A different technique is shown in FIG. 12 which employs a plug 28 having a central circumferential rib equal to the external diameter of the members, such as 24, and connectors, such as 26. This plug 28 then is inserted into the respective ends of a member 24 and connector 26 (for example) to provide a smooth outer surface connection, as illustrated.

Figure 5:
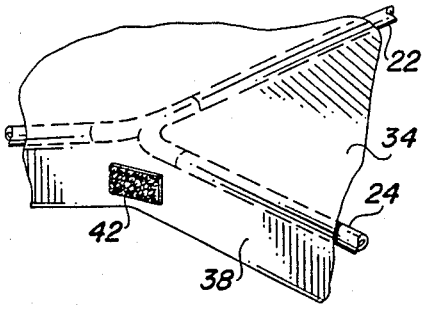
FIG. 5 illustrates the details of a portion "5" circled in FIG. 1.

Another feature of the invention is the capability of using the structure as a module, so that several shelters 20 of the type shown in FIG. 1 may be connected together to form a much larger structure such as shown in FIG. 3. A simple way of effecting this is to provide suitable male fasteners on one end of each shelter 20 and corresponding female fasteners on the other end of each shelter, so that different shelters 20 may be interconnected together in a line as shown FIG. 3. A typical fastener, which is suitable for this purpose, is a nylon "hook and eye" fastener, such as a Velcro fastener. A detailed view of one such Velcro fastener 42 is shown in FIG. 5; and it has been determined that a suitable interconnection of various shelters 20 may be effected by providing three such fasteners 42 in the positions shown in FIG. 1, one fastener adjacent each of the legs 30 and with one at the center near the ridge of the shelter. In addition, if the elongated legs 30 of the shelter 20 extend vertically instead of outwardly at an angle as shown in FIG. 1, such fasteners also may be provided on the sides of the shelters; so that the shelters 20 may be interconnected together in a variety of different patterns. Obviously, if this is done, fasteners such as the fasteners 42 would be placed on the opposite sides of the shelter 20, as well as the ends as shown in FIG. 1.

A typical size for a shelter structure of the type shown in FIG. 1 is for it to cover an area 8' by 8' or 10' by 10'. Then by connecting different ones of the structures together as shown in FIG. 3, a larger area may be covered as needed. Obviously, different dimensions may be employed; but these sizes appear to be sufficient for most applications in which the shelter is used.

The foregoing description of the preferred embodiment should be considered as illustrative only and not as limiting. Various changes and modifications will occur to those skilled in the art without departing from the true scope of the invention. For example, different techniques may be used to interconnect the ends of the fabric leg panels to the lower ends of the legs. The hook and hole arrangement which is illustrated, is simply one such technique. For example, snap fasteners may be used or fabric hook and eye or Velcro fasteners may be used. In addition, the particular shape of the shelter which has been shown is illustrative only and other shapes may be employed without departing from the invention.

We claim:

1. A portable shelter including in combination:

an open frame including a roof portion and having elongated legs extending from the roof portion to the ground, such that said frame is free-standing;

a fabric cover for placement over the roof portion of said frame;

elongated narrow fabric leg panels attached to said fabric cover adjacent each of said elongated legs of said frame and extending from the roof portion at least to a point near the ground;

means for releasably attaching each of said fabric leg panels to the elongated leg to which each said leg panel is adjacent at a point near the ground to apply tension through said leg panels to hold said fabric cover tightly in place on the roof portion of said frame.

2. The combination according to claim 1 wherein said open frame comprises tubular sections fitted together to form said frame.

3. The combination according to claim 2 wherein said tubular sections are cylindrical tubes which slip fit together to form said open frame.

4. The combination according to claim 3 wherein said fabric cover has a first portion which overlies the top of the roof portion of said open frame and further has relatively short downwardly extending portions around the edges of said first portion to form a box cover over the roof portion of said frame and the edges thereof.

5. The combination according to claim 4 wherein said means for releasably attaching each of said fabric leg panels comprises mating male and female interconnecting members attached, respectively, to the lower ends of each of said elongated legs and the lower ends of said elongated fabric leg panels for interconnection with one another.

6. The combination according to claim 5 wherein said mating male and female interconnecting members comprise a hook member attached to each of said elongated narrow fabric leg panels near the lower end thereof and each of said elongated legs has an aperture therein near the lower end thereof for receiving said hook member of the associated elongated narrow fabric leg panel.

7. The combination according to claim 6 wherein said elongated narrow fabric leg panels are dimensioned to extend along each of said elongated legs, while leaving the sides and ends of said frame open when said fabric cover is in place over the roof portion of said frame.

8. The combination according to claim 7 wherein said frame overlies a substantially rectangular area, with four elongated legs extending from the four corners of such area.

9. The combination according to claim 8 wherein the bottom ends of said elongated legs are pointed for insertion into the ground.

10. The combination according to claim 9 wherein at least some of said elongated legs include means for adjusting the length thereof.

11. The combination according to claim 10 wherein said at least said elongated legs are formed of hollow tubular material and each of said legs includes a plurality of closely spaced holes near the lower end thereof and arranged in a line parallel to the central axis of such elongated leg for receiving said hook member of the corresponding elongated narrow fabric leg panel.

12. The combination according to claim 11 further including a grommet formed adjacent the end of each of said elongated narrow fabric leg panels for receiving a stake therethrough further for anchoring said fabric leg panels to the ground.

13. The combination according to claim 1 further including male fastener elements on the downwardly extending portion of said fabric cover on one end of said cover when it is in place on said open frame and including female fastener elements on the downwardly extending portion of the box end of said fabric cover, such that pluralities of portable shelters may be interconnected by interconnecting the associated male and female fasteners of one such shelter to another.

14. The combination according to claim 13 wherein said male and female fastener elements comprise the corresponding respective portions of fabric hook and eye fasteners.

15. The combination according to claim 1 wherein said frame overlies a substantially rectangular area, with four elongated legs extending from the four corners of such area.

16. The combination according to claim 15 wherein at least some of said elongated legs include means for adjusting the length thereof.

17. The combination according to claim 1 wherein said elongated narrow fabric leg panels are dimensioned to extend along each of said elongated legs, while leaving the sides and ends of said frame open when said fabric cover is in place over the roof portion of said frame.

18. The combination according to claim 1 wherein said means for releasably attaching each of said fabric leg panels comprises mating male and female interconnecting members attached, respectively, to the lower ends of each of said elongated legs and the lower ends of said elongated fabric leg panels for interconnection with one another.

19. The combination according to claim 18 wherein said mating male and female interconnecting members comprise a hook member attached to each of said elongated narrow fabric leg panels near the lower end thereof and each of said elongated legs has an aperture therein near the lower end thereof for receiving said hook member of the associated elongated narrow fabric leg panel.

20. The combination according to claim 19 wherein said at least said elongated legs are formed of hollow tubular material and each of said legs includes a plurality of closely spaced holes near the lower end thereof and arranged in a line parallel to the central axis of such elongated leg for receiving said hook member of the corresponding elongated narrow fabric leg panel.

21. The combination according to claim 1 wherein the bottom ends of said elongated legs are pointed for insertion into the ground.

22. The combination according to claim 21 further including a grommet formed adjacent the end of each of said elongated narrow fabric leg panels for receiving a stake therethrough further for anchoring said fabric leg panels to the ground.

23. The combination according to claim 1 wherein said fabric cover has a first portion which overlies the top of the roof portion of said open frame and further has relatively short downwardly extending portions around the edges of said first portion to form a box cover over the roof portion of said frame and the edges thereof.

24. The combination according to claim 23 wherein said elongated narrow fabric leg panels are dimensioned to extend along each of said elongated legs, while leaving the sides and ends of said frame open when said fabric cover is in place over the roof portion of said frame.

25. The combination according to claim 1 wherein at least some of said elongated legs include means for adjusting the length thereof.

26. The combination according to claim 25 wherein said frame overlies a substantially rectangular area, with four elongated legs extending from the four corners of such area.

* * * * *